US006471790B1

(12) United States Patent
Fernihough

(10) Patent No.: US 6,471,790 B1
(45) Date of Patent: Oct. 29, 2002

(54) PROCESS FOR STRENGTHENING THE GRAIN BOUNDARIES OF A COMPONENT MADE FROM A NI BASED SUPERALLOY

(75) Inventor: John Fernihough, Ennetbaden (CH)

(73) Assignee: ALSTOM (Switzerland) Ltd, Baden (CH)

( * ) Notice: Subject to any disclaimer, the term of this patent is extended or adjusted under 35 U.S.C. 154(b) by 0 days.

(21) Appl. No.: 09/635,360

(22) Filed: Aug. 9, 2000

(30) Foreign Application Priority Data

Aug. 9, 1999 (EP) ..... 99810712

(51) Int. Cl.[7] ..... C23C 8/20; C23C 19/03; C23C 8/44; C23C 8/64; C23C 8/68

(52) U.S. Cl. ..... 148/409; 148/426; 148/207; 148/675

(58) Field of Search ..... 148/206, 237, 148/426, 675, 207, 409

(56) References Cited

U.S. PATENT DOCUMENTS

| | | | | | |
|---|---|---|---|---|---|
| 3,655,458 | A | * | 4/1972 | Reichman | 419/15 |
| 4,004,891 | A | * | 1/1977 | Lin et al. | 148/207 |
| 4,533,389 | A | * | 8/1985 | Kapoor et al. | 420/94 |
| 4,719,080 | A | | 1/1988 | Duhl et al. | |
| 4,790,977 | A | * | 12/1988 | Daniels et al. | 420/104 |
| 5,254,183 | A | * | 10/1993 | Harris, III et al. | 148/318 |
| 5,399,313 | A | | 3/1995 | Ross et al. | |
| 5,455,120 | A | | 10/1995 | Walston et al. | |
| 5,482,789 | A | | 1/1996 | O'Hara et al. | |
| 5,556,483 | A | * | 9/1996 | Tahara et al. | 148/206 |
| 5,556,484 | A | * | 9/1996 | Blankenship, Jr. et al. | 148/211 |
| 5,593,510 | A | * | 1/1997 | Tahara et al. | 148/225 |
| 5,598,968 | A | * | 2/1997 | Schaeffer et al. | 228/262.31 |
| 5,759,301 | A | | 6/1998 | Konter et al. | |
| 5,873,950 | A | * | 2/1999 | Ganesan et al. | 148/206 |
| 5,908,486 | A | * | 6/1999 | Flinn et al. | 148/207 |

FOREIGN PATENT DOCUMENTS

| | | |
|---|---|---|
| EP | 0235075 | 9/1987 |
| GB | 2234521 A | 2/1991 |
| GB | 2284617 A | 6/1995 |

OTHER PUBLICATIONS

ASM Handbook vol. 5: Surface Engineering, ed. by Cotell et al, Feb. 1996, pub. by ASM International, pp. 779–783.*

"Micromechanisms of Low–Cycle Fatigue in Nickel–Based Superalloys at Elevated Temperatures", Runkle and Pelloux, *Fatigue Mechanisms*, Proceedings of an ASTM–NBS–NSF symposium, May 1978, pp. 501–527.

"Einfluss der Aufkohlung auf das Kriechverhalten einer FeNiCr–Hochtemperaturlegierung", Hemptenmacher, et al., *Werkstoffe und Korrosion 35*, 1984, pp. 247–253.

"Impact Strength and Transmission Electron Microscopy Investigations of Aged and Carburized Alloy 800H", Czyrska–Filemonowicz, et al., *Nuclear Technology*, vol. 66, Jul. 1984, pp. 149–156.

"Superalloys 1996" ed . . . R. D. Kissinger et al., (Pub. The Minerals, Metals & Materials Society 1996), p. 24.

* cited by examiner

*Primary Examiner*—Roy King
*Assistant Examiner*—Harry D. Wilkins, III
(74) *Attorney, Agent, or Firm*—Burns, Doane, Swecker & Mathis, L.L.P.

(57) ABSTRACT

The invention relates to a process for the forming of precipitates of carbides and borides along the grain boundaries of an component made from an Ni based superalloy while in solid state. This follows from the finding that the carbides formed by carburization offer similar grain boundary strengthening properties as those cast into the article using the current art without the detrimental effects of adding more carbon to the alloy prior to casting. With advantage the process will be carried out in a way to form secondary caribides in the form $Cr_{23}C_6$, $Cr_7C$, $Cr_6C$ and HfC and may take place before, during or after the normal solution and/or precipitation hardening heat treatments of the component.

17 Claims, No Drawings

PROCESS FOR STRENGTHENING THE GRAIN BOUNDARIES OF A COMPONENT MADE FROM A NI BASED SUPERALLOY

This application claims priority under 35 U.S.C. §§119 and/or 365 to Appln. No. 99810712.2 filed in Europe on Aug. 9, 1999; the entire content of which is hereby incorporated by reference.

FIELD OF THE INVENTION

This invention relates to a process for strengthening the grain boundaries of a component made from a Ni based superalloy.

BACKGROUND OF THE INVENTION

Single crystal turbine components are manufactured from Ni based superalloys using a directional solidification technique. Casting a large perfect single crystal component is in practice extremely difficult, with most such components being subject to defects such as grain boundaries, freckles, equiaxed stray grains and microporosity among others. These defects generally weaken the components at high temperature, resulting in an inability to maintain a desired life of the component or a desired temperature of operation of the turbine, which will ensure high turbine efficiency, without risking component failure initiated at the defect. However, to demand nothing but perfect single crystal articles from a foundry would incur a very high scrap rate and concomitant high per-part costs. Thus, the industry trend is to accept as many defects as possible without compromising the lifetime or operating temperature of the components.

One of the most prevalent defects is grain boundaries, which are particularly harmful to the single crystal components high temperature properties. Grain boundaries are regions of high local disorder of the crystal lattice as they are the locations at which neighboring grains must join together despite a certain misorientation between their lattices. The greater the misorientation, the greater is the disorder (concentration of dislocations) in the grain boundary required to facilitate the fitting together of the two grains. This disorder is directly related to the behavior of the grain boundary at higher temperatures, making it weaker with respect to the bulk material inside the grains as temperature increases above the "equicohesive temperature", which is generally $0.5T_m$ where $T_m$ [K] is the melting point of the material.

This weakening effect has been clearly established in patent GB-A-2,234,521. The FIG. 4 of the disclosure GB-A-2,234,521 plots stress rupture strength at 871° C. tested across grain boundaries of various degrees of misorientation. Note that for the "base" material (conventional single crystal alloy) there is a sharp drop in the properties when the misorientation exceeds about 6°. The trend is also shown in "Superalloy 1996" (Ed. R. D. Kissinger et al.,The Minerals, Metals and Materials Society 1996) for the alloy Rene N for stress rupture at 1600° F. and 1800° F. The sudden weakening of the single crystal article containing grain boundaries of misorientation higher than 6° has led to the clear specification that no misorientations above 6° are acceptable.

In the past, Ni based superalloys cast to give an equiaxed grain structure or columnar-grained structure were fortified with elements such as C (carbon) and B (boron) which are known grain boundary strenghtheners, as they cause the precipitation of carbides and borides, which are stable at high temperatures, on the grain boundaries. In addition the presence of these elements in solution in the grains and along the grain boundaries slows down diffusion processes at high temperatures, which is a major source of grain boundary weakness.

It was discovered early in the evolution of single crystal alloys that the presence of significant quantities of C and B in the alloys prevented the maximum strength of the alloys from being achieved, for three main reasons:

1. with high levels of carbon, elongated carbides tend to form between dendrites during directional solidification, and these can be crack starters during service,
2. C and B increase the amount of eutectic in the as-cast article, which degrades LCF (Low cycle fatigue) and creep properties and
3. C and B dramatically lower the melting point of the alloy. At the levels present in DS alloys, the incipient melting point is often lower than the gamma prime solvus temperature, which prevents a complete solutioning of gamma prime and re-precipitating at the desired size range, and prevents the complete solutioning of gamma/gamma prime eutectic. This can have a dramatic effect on LCF and creep properties.

For these reasons, C and B levels were kept extremely low in the first generation single crystal superalloys. However, patent GB-A-2,234,521 shows that high temperature properties can be maintained with levels of carbon higher than in conventional single crystal alloys but lower than in previous art DS alloys. The invention disclosed in GB-A-2,234,521 has allowed to raise the defect toleration specification from 6° to 12° for the new alloy, hence the concept of "defect tolerant alloy".

It is recognized that the general trend in the most recent generation of patented single crystal Ni based superalloys is towards levels of C from 250 ppm to 600 ppm. Recent patents, e.g. U.S. Pat. Nos. 5,455,120 and 5,399,313, discloses a range from 200 up to 700 ppm C, the U.S. Pat. No. 5,482,789 a range from 0–600 ppm C, while the recent patent U.S. Pat. No. 4,719,080 from United Technologies discloses a range from 0 up to 450 ppm C. A range of 200–400 ppm C is also disclosed in the patent U.S. Pat. No. 5,759,301 for a Ni based single crystal superalloy.

Although the highest content of carbon disclosed in the above mentioned documents is 700 ppm, publications indicate that the commercially used versions of these alloys contain 500 ppm C. The reasons for this limit, despite the knowledge that higher amounts of carbon would further increase grain boundary strength, are described above. No solution for this problem of the current art has ever been disclosed. The current art improves grain boundary strength in single crystal alloys exclusively by having carbon as an alloying element in the casting alloy, so that carbides form along the grain boundaries during solidification due to segregation of carbide forming elements to the grain boundaries.

The patent U.S. Pat. No. 5,598,968 discloses a method of using carburization to precipitate carbides in the surface layer of a superalloy article in order to prevent recrystallization during subsequent heat treatment.

However, U.S. Pat. No. 5,598,968 is specifically addressing articles that have been or will be cold worked, and the carburization depth desired is associated with the depth of cold working of the surface. Patent U.S. Pat. No. 5,598,968 also discloses only for the carburization as being part of a process in which there is a) cold work and b) subsequent heat treatment during which recrystallization may occur. It is recognised that such a heat treatment, which may cause recrystallization, must approach the gamma prime solvus temperature of the Ni based superalloy.

The desired effect of patent U.S. Pat. No. 5,598,968 is obtained once the surface of the superalloy is carburized and caused to grow a dispersion of carbides up to a certain predetermined depth in the surface of the component. No mention is made of grain boundaries.

Note also that patent U.S. Pat. No. 5,598,968 implies that the surface carbide dispersion will be left in the article during service. It is disclosed that the carbides help to prevent the formation of the undesirable Secondary Reaction Zone (SRZ)—which forms during service, and obviously must be left on for the heat treatment. Those skilled in the art recognise the SRZ is a problem to high Re alloys in which undesirable precipitates form at various locations but particularly at the surface layer of a coated component. SRZ will precipitate after several thousand hours of services, hence the need to leave the carbide dispersion in the surface layer during the service life of the part.

It is industry standard to use grit blasting at least twice during normal routing: once to clean the surface in preparation for grain etching and again to prepare the surface for fluorescent penetrant inspection. As each grit blasting operation removes from 10–25 $\mu$m of surface material, by definition most of the surface carburization as described in patent U.S. Pat. No. 5,598,968 will be removed. Importantly, as the cold work to be done to the articles described in the patent U.S. Pat. No. 5,598,968 can only be done on the outside, and the carburization is required only where the material has undergone cold work, it is clear that the intention is not to obtain or control for carburization from inside the component when the component is hollow—as in turbine blades and vanes with cooling passages. It would be nearly inconceivable that patent U.S. Pat. No. 5,598,968 would lead to a full carburization of the grain boundaries with the small one-sided surface penetration specified in the patent.

SUMMARY OF THE INVENTION

It is the object of the present invention to find a novel method of treatment of Ni based superalloy articles, particularly for but not limited to single crystal articles, in order to introduce C or B into the grain boundaries while these articles are in the solid state, which means after casting. Carbon or Boron (or both) shall be introduced into the grain boundaries of the article so that the grain boundaries show at least higher C and/or B levels than normally observed after casting, using an alloy composition with the maximum C or B levels as specified in the manufacturing instructions for the alloy for use in that component in particular with no upper limit. This invention follows the finding that the carbides formed by carburization offer similar grain boundary strengthening properties as those cast into the article using the current art without the detrimental effects of adding more carbon to the alloy prior to casting.

The method of processing may include a means of introducing carbon and/or boron simultaneoulsy on the outer working surface of the article as well as on the inner working surface, e.g. the cooling configuration of a turbine blade.

The desired effect of the present invention is to introduce carbon along the grain boundaries with no regards to effects at the surface. Rather than measuring the carburization effect in terms of width of carburization in the overall surface, the effect is measured as carburization only along the grain boundaries in the cast article. The desired depth of carburization in the present invention is decided by the physical design of the component and where the grain boundaries occur: That is, the wall thickness in which the grain boundary is found determines the depth of the grain boundary and hence the depth of carburization, not all grain boundaries in the part need be carburized, only those experiencing high loadings at high temperatures. This may be up to 3 or more mm in depth. Importantly, the carburization (and/or Boron enrichment) step may be carried out with no association to any other heat treatment which may cause recrystallization, and may be done before, during or after such a heat treatment.

In addition, one advantageous embodiment of the present invention is that the surface layer of carbides may be removed by chemical or mechanical means because this surface layer is inconsequential to the desired effect of carburization of the grain boundaries.

The precipiates are formed advantageously from the group of secondary carbides such as HfC, $M_{23}C_6$, $M_6C$, $M_7C$ wherein M is a metal, preferred Cr.

DETAILED DESCRIPTION OF THE INVENTION

The present invention relates to a process of treatment a solid state component made from a Ni based superalloy to strengthen the grain boundaries. This is achieved by introducing into the grain boundaries carbon and/or boron. This follows from the finding that the carbides formed by carburization offer similar grain boundary strengthening properties as those cast into the article using the current art.

Carbon is introduced along the grain boundaries by any standard carburization process. The carburization process is a very well established art used for cast irons and steels. For example, carburization can be carried out at a Ni based superalloy disclosed in U.S. Pat. No. 5,759,301 in a vacuum atmosphere of between about 200 and about 760 torr with a ratio of methane to hydrogen of about ten to one, and at a temperature of about 980° C. to about 1090° C. (about 1900° F. to about 2100° F.), with a suitable carburization treatment involving exposure to a temperature of about 1080° C. (about 1975° F.) for a duration of about one hour. However due to the greater depth of carburization desired the times can be in the range of 2–20 hours. Any method of bringing a high carbon potential gas, liquid or solid into contact with the superalloy article to be carburized is suitable for this invention. For example, pack carburization, mixtures of carbon monoxide and carbon dioxide gases, mixtures of gases containing metallo-organics, mixtures of methane and hydrogen, etc.

The carburization step may be carried out so that carbides precipitate during the carburization, or the carbides may be precipitated as desired during subsequent heat treatments. In addition, there may be alternating carburizing and carbide-precipitation steps during the carburization process by manipulating the carbon potential, temperature and other conditions. The desired end result is a precipitation of "blocky" and well separated carbides along the grain boundaries.

Boron may be introduced into the grain boundaries in a similar manner, using any method that brings B containing gas, liquid or solid species into contact with the already cast superalloy article.

The introduction of C and/or B may be done at the same time as the solution heat treatment and/or subsequent precipitation heat treatments. This would allow, for example, a carburization time of several hours at high temperature while using no extra furnace time.

In fact, when the inventive process is carried out as a manufacturing step of new components, it may be done before, during and possibly after the solution and/or precipitation heat treatments of the component.

Before applying the process there may be a cleaning process to remove oxides and other undesirable contaminants in preparation for carburization. In addition after carburization a layer of carbon enriched material on the surface of the component may be chemically or mechanically removed before the component is put into service. This is to avoid possible interference of the surface carbides with the coating.

The present upper limit on carbon disclosed in the most recent generation of single crystal superalloys is 700 ppm, and publications strongly imply that commercially used versions use no more than 500 ppm. As previously discussed, this upper limit is set because higher levels of carbon (and also boron) promote 1. larger script like carbides/borides which promote crack initiation in service,
2. lower incipient melting temperatures which prevents full solutioning of gamma prime, leading to decreased high temperature properties,
3. increased volume fraction of eutectic which further decreases high temperature properties.

All of these contraints are direct results of how carbon behaves during the solidification during casting of the superalloy article. Because the present invention allows the introduction of carbon after casting, in the solid state, higher levels of carbon will not have any of these undesireable effects but will strengthen the grain boundaries. This will have the beneficial result that parts that are currently scrapped from the casting foundary due to grain boundaries that show misorientations higher than presently accepted can now be accepted (up to certain higher limits of grain boundary misorientation). This lowers the end cost of these parts. In addition, parts that are normally accepted with grain boundaries will be additionally strengthened along those grain boundaries, thereby decreasing the risk for cracking initiated at the grain boundaries which are heavily loaded in service.

An important benefit of solid state carburization comes from the type of carbides precipitated. It is recognized that carbides forming during casting always form as "MC" carbides, which are TaC and TiC. The thermodynamics for TiC and TaC change from liquid to solid state of the superalloy: they are more stable to form in the liquid during solidification but are less stable in the solid state, and are known to decompose while carbides such as HfC, $Cr_{23}C_6$, $Cr_6C$, $Cr_7C$ and other so called "secondary" carbides form in their place.

This presents several problems which further limit the use of higher amounts of carbon in single crystal or directionally solidified superalloys according to the present art:

1) Ti and Ta are tied up in the carbides, and since Ti and Ta are gamma prime forming elements, this has the effect of decreasing the overall volume fraction of gamma prime in the alloy which decreases high temperature properties. As the carbon level rises, so do high temperature properties decrease from the decreased level of gamma prime.
2) as the Ti and Ta diffuse away from the MC carbides which decompose during heat treatments and/or service at high temperature, they can form continuous films of gamma prime around the carbides. When there are many carbides along a grain boundary, this can lead to continuous films of gamma prime along the grain boundary (well known as grain boundary embrittlement). This has already proved problematic with some directionally solidified and many equiaxed alloys with high amounts of carbon. However most of these alloys contain no Re, which slows down the diffusion of Ti and Ta. In modern single crystal alloys, most of which contain Re, the diffusion of Ti and Ta away from the decomposing MC carbides will be slowed down significantly, thereby increasing the problem of grain boundary films of gamma prime, which obviously severely degrade properties of the article.

Both of these problems are avoided by controlling the carburization conditions so that only chromium carbides or hafnium carbides or other secondary long-term stable carbides are formed.

What is claimed is:

1. A process for strengthening grain boundaries of a cast component made from a single crystal or columnar grain type Ni based superalloy, the process comprising:

applying a solid, liquid or gas containing at least one of carbon or boron to a surface of the component said surface containing at least one grain boundary found within the component;

allowing sufficient time for the at least one of carbon or boron to diffuse into the at least one grain boundary of the component; and forming precipitates comprising at least one of carbides or borides on the grain boundaries throughout the component while the component is in the solid state.

2. The process of claim 1, wherein the precipitates comprise a secondary carbide.

3. The process of claim 2, wherein the precipitates comprise one or a combination of HfC, $M_{23}C_6$, $M_7C$ or $M_6C$, wherein M is a metal.

4. The process of claim 3, wherein the precipitates comprise one or a combination of HfC, $Cr_{23}C_6$, $Cr_7C$ or $Cr_6C$.

5. The process of claim 1, further comprising removing a layer of carbon enriched material from the surface of the component chemically or mechanically after forming the precipitates and before the component is put into service.

6. The process of claim 5, wherein the precipitates are formed before any solution or precipitation hardening heat treatments.

7. The process of claim 5, wherein the precipitates are formed during solution or precipitation hardening heat treatments.

8. The process of claim 5, wherein the precipitates are formed after solution or precipitation hardening heat treatments.

9. The process of claim 6, further comprising cleaning oxides and other undesirable contaminants from the surface of the component before forming the precipitates.

10. The process of claim 1, wherein at least one of a carbon or boron content of the cast Ni-based superalloy after a carburizing or boronizing treatment is greater than the carbon or boron content of the cast Ni-based superalloy in an as-cast condition.

11. The process of claim 1, wherein the component has been newly formed in a casting process.

12. A Ni-based superalloy comprising strengthened grain boundaries formed by the process of claim 1.

13. The Ni-based superalloy of claim 12, comprising at least 500 ppm carbon.

14. The Ni-based superalloy of claim 12, comprising at least 700 ppm carbon.

15. A turbine component formed from a Ni-based superalloy comprising strengthened grain boundaries formed by the process of claim 1.

16. The component of claim 15, comprising at least 500 ppm carbon.

17. The component of claim 15, comprising at least 700 ppm carbon.

* * * * *